United States Patent [19]

Manzoni

[11] 4,281,875

[45] Aug. 4, 1981

[54] PLASTICS MATERIAL SUPPORTING ELEMENT, MOLDED IN THE FORM OF INTERLACED STRAW, EFFECTIVE TO BE FIXED TO A CHAIR BODY

[76] Inventor: Mario Manzoni, Via Gramsci, 29/B, 20032 Cormano (Milano), Italy

[21] Appl. No.: 14,910

[22] Filed: Feb. 26, 1979

[30] Foreign Application Priority Data

Mar. 17, 1978 [IT] Italy ..... 21199/78[U]

[51] Int. Cl.[3] ..... A47C 7/16

[52] U.S. Cl. ..... 297/452; 160/371

[58] Field of Search ..... 160/371, 380; 297/443, 297/452

[56] References Cited

U.S. PATENT DOCUMENTS

| | | | |
|---|---|---|---|
| 118,079 | 8/1871 | Watkins | 160/371 |
| 4,079,529 | 3/1978 | Jennen et al. | 160/380 |

FOREIGN PATENT DOCUMENTS

| | | | |
|---|---|---|---|
| 495209 | 4/1930 | Fed. Rep. of Germany | 160/371 |
| 336120 | 10/1930 | United Kingdom | 160/371 |

*Primary Examiner*—Rodney H. Bonck

*Attorney, Agent, or Firm*—Bucknam and Archer

[57] ABSTRACT

A supporting structure, effective to act as a chair seat and/or back, and to be fixed to a chair body, is described which consists of a substantially flat structure, structure having a suitable thickness and being made of a suitable plastics material, the structure having the form of an interlacing of straw stems, or other similar vegetal materials, defining a plurality of holes. The structure may be obtained in any flat geometrical shape, depending on the shape of the frame with which it must be associated, the structure is provided, peripherically, with an upper edge and lower lug, provided, at even spacings, with tabs, the tabs defining an outer tooth effective to engage into suitable slots formed in said structure supporting frame.

1 Claim, 5 Drawing Figures

PLASTICS MATERIAL SUPPORTING ELEMENT, MOLDED IN THE FORM OF INTERLACED STRAW, EFFECTIVE TO BE FIXED TO A CHAIR BODY

The present invention relates to a plastics material supporting element, effective to act as a chair seat or back and molded in the form of interlaced straw, and effective to be fixed to the body of a chair provided with a suitably designed supporting frame.

As it is known, the making of chairs having the seat or back thereof covered with straw has been practically abandoned due to the practical difficulties involved in the operation of interlacing the stems of the straw or other similar vegetal materials.

In fact, this operation is very tedious, requiring a remarkable amount of labor, which causes the cost of the final products to prohibitively increase.

The aforesaid economical drawbacks, are, on the contrary, eliminated by the plastics material chair seat and/or back according to the present invention.

In fact the chair seat and/or back is molded in such a way as to assume, at the surface, the typical aspect of the interlaced straw.

The chair seat and/or back, is obtained with a shape corresponding to that of the related supporting frame and is perimetrically provided with tooth lower lugs effective to engage with suitable slots formed in the frame itself.

Practically, the instant chair seat and/or back presents itself as a structure obtained by interlacing straw stems, and in the meanwhile the cost is very reduced.

Furthermore said structure may be easily cleaned and is devoid of those frays usually occurring in the straw covered seats.

Moreover, the same structure, may be easily obtained, not only with the straw color, but with any other color.

These and other characteristics, of functional and constructive nature of the plastics material chair seat and/or back, according to the present invention will become more apparent from the figures of the accompanying drawing, where:

Figure 1:
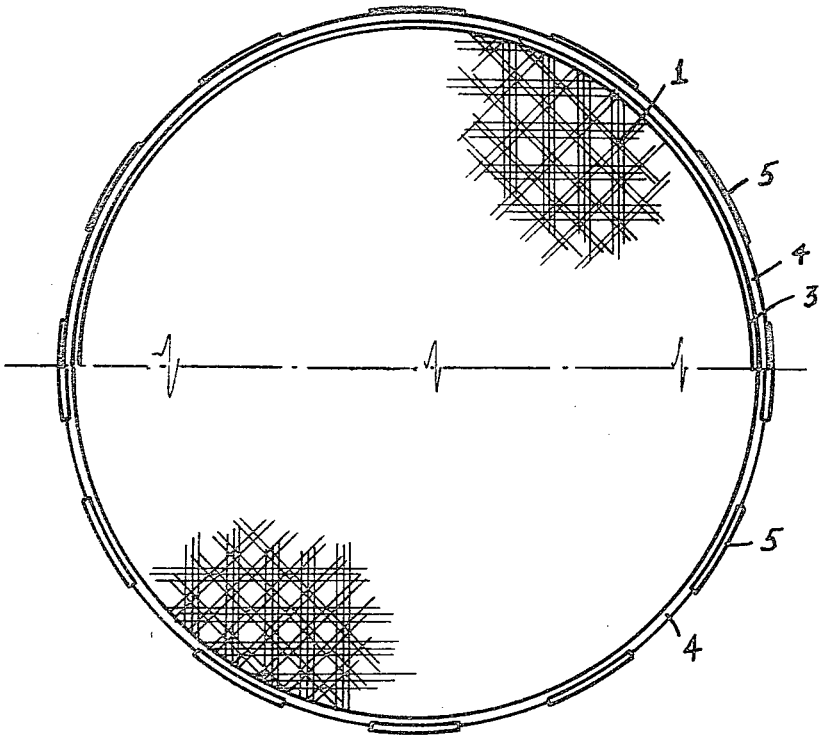
FIG. 1 illustrates, by a half upper view and a half bottom view, an embodiment of the instant chair seat and/or back, of round shape.
Figure 2:
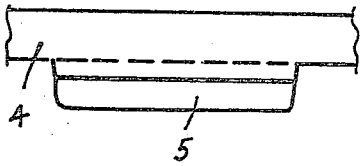
FIG. 2 illustrates one of the lugs as perimetrically formed on that same chair seat and/or back.
Figure 3:
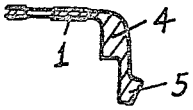
FIG. 3 is a cross section view of said lug.
Figure 4:
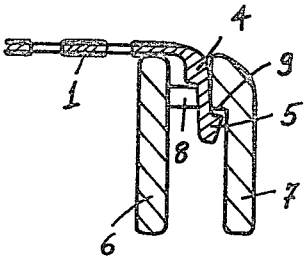
FIG. 4 illustrates the anchoring procedure of that same lug to the seat and/or back supporting frame.
Figure 5:
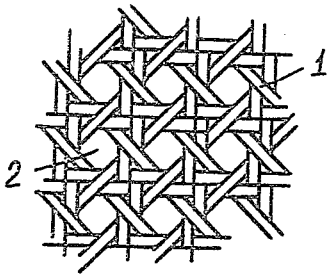
FIG. 5 illustrates a detail of the interlaced arrangement, as formed on two surfaces of the seat and/or back.

Referring particularly to the numerical references of the figures of the accompanying drawing, the chair seat and/or back, effective to be fixed to a chair body, according to the present invention, consists of a substantially planar or flat structure (1), the structure being made of a suitable plastics material and having a suitable thickness.

More specifically said structure assumes, by a molding step, the aspect of an interlacing of straw stems, or other similar vegetal materials, defining, preferably, a plurality of holes (2).

The same structure may be obtained in any other geometrical flat shape, depending on the shape of the frame to which the structure has to be associated, being provided, peripherically, with an upper edge (3) and a lower lug (4).

The lower lug is provided, at even spacings, with tabs (5) defining an outer tooth effective to engage into suitable slots as formed in said structure supporting frame.

More precisely, said frame is formed by two parallel elements (6) and (7) connected by an annular connecting element (8) therethrough are formed slots.

Furthermore, the outer one of the parallel elements defines an inner upper ridge (9) against which engages the tooth of the tab (5), thereby providing the anchoring of the structure (1) to said frame.

Finally, it should be pointed out that the structure (1) may be obtained both strawcoloured and with any other colour.

From the above description and the examination of the several figures of the accompanying drawing, the great functionality and use facility characterizing the plastics material chair seat effective to be applied to a chair body, according to the present invention, are self evident.

I claim:

1. The combination of a supporting element (1) acting as a chair seat or back, and a chair frame wherein said chair frame consists of two vertically extending parallel elements (6,7) and an annular element (8) connecting said two parallel elements, said annular connecting element being provided with slots, and wherein the outer one of said two vertically extending parallel elements is provided with an inner upper ridge (9), and wherein the supporting element consists of a substantially flat structure, said structure having a suitable thickness and being made of a suitable plastics material, said structure having the appearance of interlaced straw stems, or the like, defining a plurality of openings (2), said structure being provided with an upper peripheral edge (3) and downwardly projecting lugs (4), said lugs being provided with spaced tabs (5), said tabs being engageable with said slots formed in said annular connecting elements.

* * * * *